US006185398B1

(12) United States Patent
Tanaka et al.

(10) Patent No.: US 6,185,398 B1
(45) Date of Patent: Feb. 6, 2001

(54) ELECTROPHOTOGRAPHIC PHOTOSENSITIVE MEMBER, PROCESS CARTRIDGE AND ELECTROPHOTOGRAPHIC APPARATUS

(75) Inventors: Takakazu Tanaka, Numazu; Hidetoshi Hirano, Shizuoka-ken; Hirotoshi Uesugi, Numazu, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/356,555

(22) Filed: Jul. 19, 1999

(30) Foreign Application Priority Data

Jul. 21, 1998 (JP) ..... 10-205265

(51) Int. Cl.[7] ..... G03G 15/02

(52) U.S. Cl. ..... 399/174; 430/66; 430/67; 430/59.6

(58) Field of Search ..... 430/66, 67, 59.6; 399/174

(56) References Cited

U.S. PATENT DOCUMENTS

| | | | | |
|---|---|---|---|---|
| 4,284,699 | * | 8/1981 | Berwick et al. | 430/59.6 |
| 4,551,403 | * | 11/1985 | Miyakawa et al. | 430/59.6 |
| 4,769,304 | | 9/1988 | Kondo et al. | 430/96 |
| 5,258,252 | * | 11/1993 | Sakai et al. | 430/66 |
| 5,538,826 | | 7/1996 | Anitoya et al. | 430/67 |
| 5,876,890 | | 3/1999 | Kitamura | 430/96 |

FOREIGN PATENT DOCUMENTS

| | | |
|---|---|---|
| 3215646 | 11/1982 | (DE) . |
| 56-167759 | 12/1981 | (JP) . |
| 57-017826 | 1/1982 | (JP) . |
| 57-019576 | 2/1982 | (JP) . |
| 58-040566 | 3/1983 | (JP) . |
| 61-228453 | 10/1986 | (JP) . |
| 61-272754 | 12/1986 | (JP) . |
| 63-149668 | 6/1988 | (JP) . |

* cited by examiner

*Primary Examiner*—Roland Martin
(74) *Attorney, Agent, or Firm*—Fitzpatrick, Cella, Harper & Scinto

(57) ABSTRACT

An electrophotographic photosensitive member is constituted by a support and a photosensitive layer disposed on the support. The electrophotographic photosensitive member has a surface layer comprising a polyester resin having a recurring unit represented by the following formula (1):

(1)

wherein $A_1$ represents a substituted or unsubstituted divalent aliphatic hydrocarbon group. The resultant surface layer is effective in improving an abrasive resistance of the photosensitive member.

12 Claims, 1 Drawing Sheet

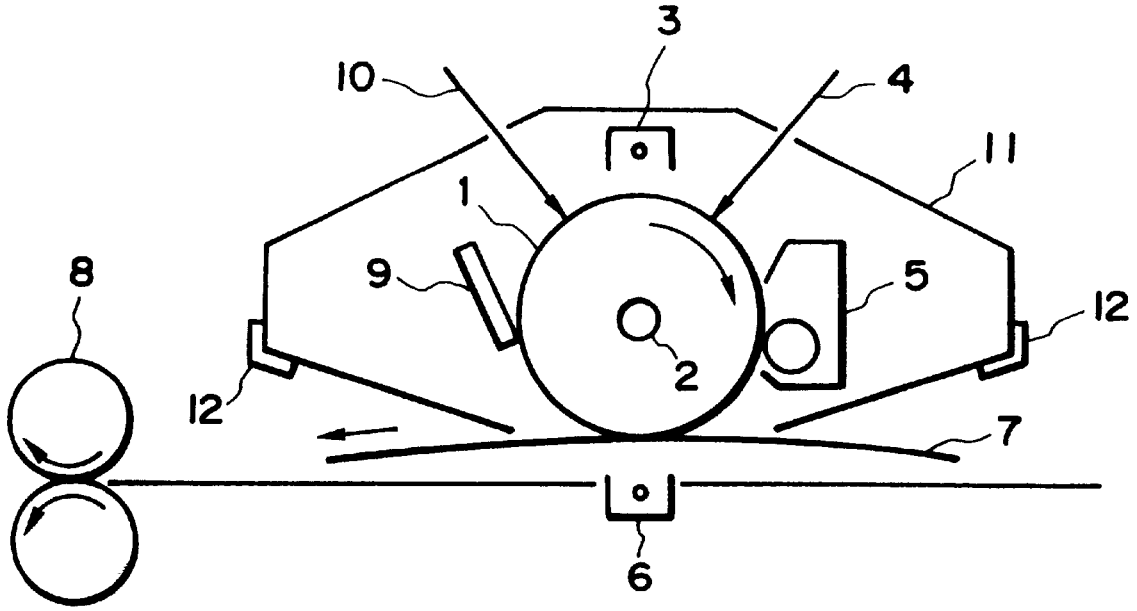
3
10
4
11
1
9
5
12
8
2
12
7
6

ELECTROPHOTOGRAPHIC PHOTOSENSITIVE MEMBER, PROCESS CARTRIDGE AND ELECTROPHOTOGRAPHIC APPARATUS

FIELD OF THE INVENTION AND RELATED ART

The present invention relates to an electrophotographic photosensitive member, particularly an electrophotographic photosensitive member having a surface layer comprising a specific (polyester) resin, a process cartridge including the photosensitive member, and an electrophotographic apparatus using the photosensitive member.

In recent years, there have been developed electrophotographic photosensitive members utilizing various organic photoconductive compounds.

Such organic photoconductive compounds have different sensitive wavelength regions depending on the compounds used. In this regard, Japanese Laid-Open Patent Applications (JP-A) 61-272754 and 56-167759 disclose azo pigments showing a high (photo-)sensitivity in a visible (wavelength) region. Further, JP-A 57-19576 and JP-A 61-228453 disclose compounds showing a sensitive wavelength region extending in an infrared (wavelength) region. Of these compounds (pigments), those showing a sensitivity also in the infrared region are suitable for use in laser beam printers and LED (light-emitting diode) printers and have more frequently been employed in recent years.

The photosensitive member is generally required to have good characteristics in terms of sensitivity, electrical characteristics, mechanical characteristics and optical characteristics. Particularly, when the photosensitive member is repetitively used, electrical and mechanical external forces are directly exerted on a surface layer of the photosensitive member during a sequence of, e.g., charging-exposure-developing-transfer-cleaning in an ordinary electrophotographic process. As a result, the surface layer of the photosensitive member is required to have durabilities against such external forces, such as a durability against a deterioration due to ozone and nitrogen oxides generated in the charging step and a durability against electrical and mechanical deteriorations due to surface abrasion and/or mars caused by charging (discharging) and/or cleaning.

Particularly, an organic photosensitive member uses a softer organic photoconductive compound (substance) in many cases when compared with an inorganic photosensitive member, and thus is required to improve its durability against mechanical deterioration.

Further, in recent years, there has been mainly used, as a charging scheme, a contact (or direct) charging scheme wherein a photosensitive member is charged by applying a voltage to a charging member disposed in contact with the photosensitive member as described in JP-A 57-17826 and JP-A 58-40566.

The contact charging scheme has the advantages of less ozone generation and high charging efficiency when compared with the case of a corona discharge scheme using scorotron liable to cause ozone generation and inefficient charging due to a large amount of current passing through a shield (ca. 80% based on that of current to be supplied to a charger), thus resulting in a very economical and effective charging scheme.

The contact charging scheme is used in contact with a photosensitive member. Accordingly, the photosensitive member is required to have a further improved mechanical strength.

Further, the use of a contact (direct) charging scheme utilizing a DC (direct-current) voltage superposed with an AC (alternating-current) voltage has been proposed in order to enhance charging stability (JP-A 63-149668).

However, while the contact charging scheme (as described in JP-A 63-149668) can improve charging stability, it is accompanied by a problem such that an amount of current passing through a photosensitive member is liable to be remarkably increased due to the use of the AC voltage which results in a larger amount of abrasion of the photosensitive member.

As described above, the electrophotographic photosensitive member is required to have not only mechanical strength but also electrical strength.

SUMMARY OF THE INVENTION

An object of the present invention is to provide an electrophotographic photosensitive member having solved the above-mentioned problems and providing excellent mechanical and electrical strengths even in repetitive use for a long period of time.

Another object of the present invention is to provide a process cartridge including the photosensitive member and an electrophotographic apparatus including the photosensitive member.

According to the present invention, there is provided an electrophotographic photosensitive member, comprising: a support and a photosensitive layer disposed on the support, wherein said electrophotographic photosensitive member has a surface layer comprising a polyester resin having a recurring unit represented by the following formula (1):

(1)

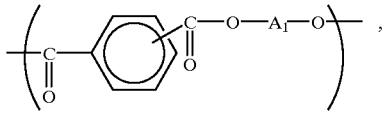

wherein $A_1$ represents a substituted or unsubstituted divalent aliphatic hydrocarbon group.

According to the present invention, there is also provided a process cartridge detachably mountable to an electrophotographic apparatus main body, comprising the above-mentioned electrophotographic photosensitive member and at least one means selected from the group consisting of charging means, developing means and cleaning means.

According to the present invention, there is further provided an electrophotographic apparatus comprising the above-mentioned electrophotographic photosensitive member, charging means, exposure means, developing means and transfer means.

These and other objects, features and advantages of the present invention will become more apparent upon a consideration of the following description of the preferred embodiments of the present invention taken in conjunction with the accompanying drawing.

BRIEF DESCRIPTION OF THE DRAWING

The sole FIGURE is a schematic sectional view of an embodiment of an electrophotographic apparatus including a process cartridge using an electrophotographic photosensitive member according to the present invention.

DETAILED DESCRIPTION OF THE INVENTION

In the present invention, an electrophotographic photosensitive member is characterized by a surface layer comprising a polyester resin having a structural (recurring) unit represented by the formula (1) shown hereinabove having a partial structure (—$A_1$—) comprising a substituted or unsubstituted divalent aliphatic hydrocarbon group.

Herein, the "aliphatic hydrocarbon group" means a (divalent) hydrocarbon group derived from an aliphatic compound which may have a chain (open-ring) structure and/or a cyclic (closed-ring) structure unless the compound exhibits aromaticity.

In the present invention, the polyester resin (having the structural unit of the formula (1)) constituting the surface layer of the photosensitive member has an iso- and/or terephthalic acid structure providing rigidity and an aliphatic hydrocarbon structure providing flexibility or toughness in combination as its molecular structure. Based on this combination (of rigidity and toughness), the resultant polyester resin is considered to be remarkably improved in mechanical strength.

The polyester resin is also effective in preventing an electrical deterioration.

The reason therefor has not been clarified as yet but may be attributable to a structure which is considerably resistant to oxidation considered to be one of factors causing the electrical deterioration of the photosensitive member.

In the present invention, in view of compatibility (mutual solubility) with a charge-transporting material, the divalent aliphatic hydrocarbon group ($A_1$ in the formula (1)) constituting the polyester resin may preferably be a divalent group represented by the following formula (2):

$$—R_1—A_2—R_2— \quad (2),$$

wherein $R_1$ and $R_2$ independently denote a substituted or unsubstituted alkylene group and $A_2$ denotes a substituted or unsubstituted alicyclic hydrocarbon group.

Examples of the (divalent) aliphatic hydrocarbon group for $A_1$ and $A_2$ (in the formulas (1) and (2)) may include methylene, ethylene, propylene, butylene, pentylene, hexylene, cyclopentylene, cyclohexylene, cycloheptylene and combinations of these groups. Of these groups, those having an alicyclic structure are examples for $A_2$.

Examples of the alkylene group for $R_1$ and $R_2$ may include methylene, ethylene and propylene.

Examples of substituents for $A_1$, $A_2$, $R_1$ and $R_2$ in the formulas (1) and (2) may include alkyl groups such as methyl, ethyl and propyl and halogens such as fluorine, chlorine and bromine.

The polyester resin constituting the surface layer of the photosensitive member according to the present invention may preferably have a structural unit of the following formula (3):

(3)

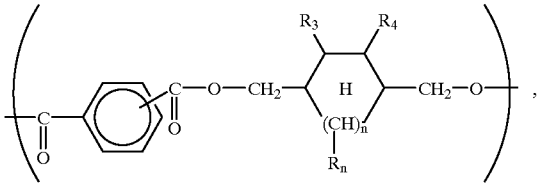

wherein $R_3$, $R_4$ and $R_n$ independently denote hydrogen, halogen or an alkyl group; and n is 1, 2 or 3.

In the above formula (3), examples of halogen for $R_3$, $R_4$ and $R_n$ may include fluorine, chlorine and bromine and examples of alkyl group may include methyl, ethyl and propyl.

In a preferred embodiment, $R_n$ in the formula (3) is hydrogen. Particularly, $R_3$, $R_4$ and $R_n$ may more preferably be hydrogen at the same time.

When n in the formula (3) is 2 or 3, two or three $R_n$ groups may be identical to or different from each other.

In the present invention, the polyester resin may preferably be a copolymer in view of solubility. Particularly, the copolymer may preferably have a plurality of structural units at least one of which contains a divalent alicyclic hydrocarbon group. It is further preferred to use a copolymer having a first structural unit having a divalent alicyclic hydrocarbon group and a second structural unit having a divalent chain (open-ring) aliphatic hydrocarbon group. More specifically, the polyester resin may preferably comprise a copolymer having a first structural (recurring) unit represented by the following formula (4) and a second structural (recurring) unit represented by the following formula (5):

(4)

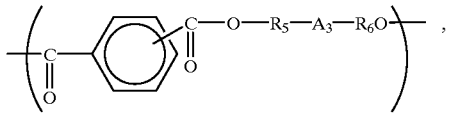

wherein $R_5$ and $R_6$ independently denote a substituted or unsubstituted alkylene group and $A_3$ denotes a substituted or unsubstituted divalent alicyclic hydrocarbon group; and (5)

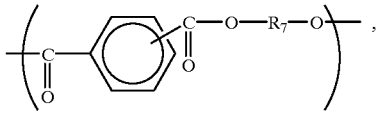

wherein $R_7$ denotes a substituted or unsubstituted divalent chain aliphatic hydrocarbon group.

In the formula (4), examples of $R_5$, $R_6$ and $A_3$ may include those of $R_1$, $R_2$ and $A_3$ in the formula (2) described above, respectively.

In the formula (5), examples of the divalent chain aliphatic hydrocarbon group for $R_7$ may include methylene, ethylene, propylene, butylene, pentylene, hexylene and heptylene.

$R_7$ in the formula (5) may have a substituent of halogen, such as fluorine, chlorine or bromine but may preferably be an unsubstituted divalent chain aliphatic hydrocarbon group. More specifically, the second structural unit of the formula (5) may preferably be represented by the following formula (6):

(6)

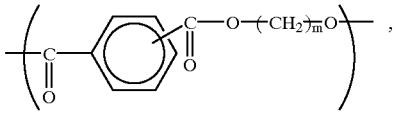

wherein m is an integer of 2–6.

Accordingly, as the polyester resin, it is particularly preferred to use a copolymer having a first structural unit of the above-mentioned formula (3) and a second structural unit of the above-mentioned formula (6).

In the present invention, the polyester resin may have another structural unit in addition to the structural unit of the formula (1) described above within a range providing a desired effect of the present invention. Further, in addition to the above-mentioned polyester resin, the surface layer of the photosensitive member may further contain polycarbonate resin or polyarylate (aromatic polyester) resin.

Specific examples of the structural unit in the formula (1) may include those shown below.

(1)

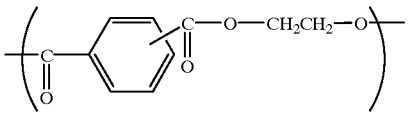

(2)

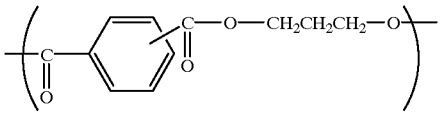

(3)

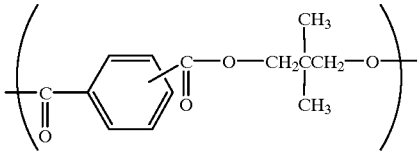

(4)

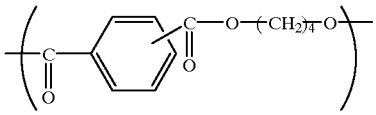

(5)

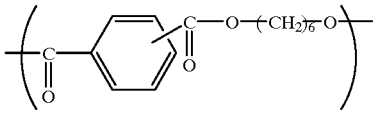

(6)

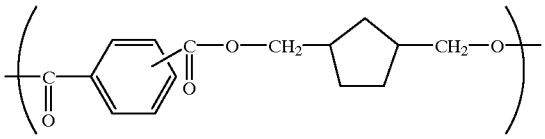

(7)

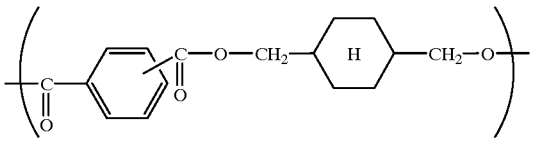

(8)

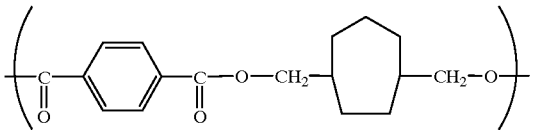

(9)

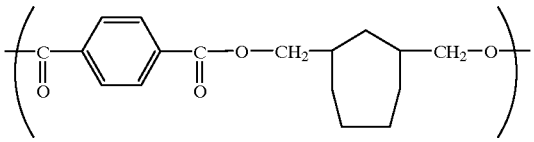

-continued (10)

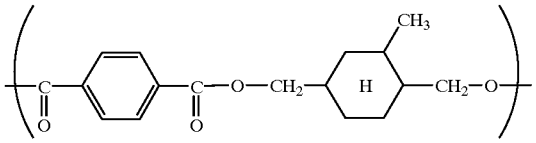

(11)

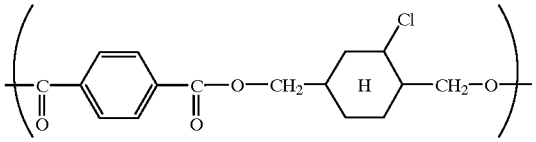

Among these structural unit, structural unit Nos. (6) and (7) are particularly preferred.

The polyester resin used in the present invention may preferably have a weight-average molecular weight (Mw) of 15,000–200,000, more preferably 20,000–50,000.

The polyester resin may be produced through a polymerization (polycondensation) of at least one species of a dicarboxylic acid component with at least one species of a dihydroxy alcohol component.

The dicarboxylic acid component may include terephthalic acid, isophthalic acid, terephthaloyl chloride and isophthaloyl chloride. The dihydroxy alcohol component may include aliphatic or alicyclic diols from which corresponding divalent aliphatic hydrocarbon groups (e.g., $A_1$ in the formula (1)) can be derived.

When a terephthalic acid (or chloride) and a isophthalic acid (or chloride) are used in combination (as a mixture), a molar ratio therebetween may preferably be ca. 1:1 in view of mutual solubility.

When the polyester resin comprises a copolymer having a plurality of structural (recurring) units, a structural (recurring) unit of the formula (1), preferably of the formula (2), may occupy at least 5 mol. %, preferably 40–80 mol. %, based on the entire structural units.

SYNTHESIS EXAMPLE 3.0 mol of cyclohexanedimethanol, 2.0 mol of ethylene glycol and 5.0 mol of a mixture of terephthalic acid and isophthalic acid (1:1 by mol) were placed in a stainless steel vessel and stirred for 30 minutes under heating at 250° C., followed by further stirring for 2 hours at 280° C.

After the reaction, the reaction mixture was cooled and dissolved in 3 liters of chloroform, followed by re-precipitation from methanol.

The precipitate was recovered by filtration and dried to obtain a colorless polymer corresponding to Resin No. 4 (consisting of the structural unit (1) and the structural unit (7)) appearing in Examples described hereinafter (Mw=32,000, Yield=74%).

Other polyester resins used in the present invention (e.g., those having at least one species of the structural units (1)–(11)) may be produced in a similar manner as in Synthesis Example by appropriately changing materials and proportions of the dicarboxylic acid component and the dihydroxy alcohol component.

In the photosensitive member according to the present invention, the surface layer may be a part of or all of a photosensitive layer formed on a substrate or a protective layer formed on the photosensitive layer.

When the photosensitive layer is a single layer containing a charge-generating material and a charge transporting material at the same time, the single layer-type photosensitive layer corresponds to the surface layer.

When the photosensitive layer comprises a lower layer (comprising a charge generation layer containing a charge-generating material or a charge transport layer containing a charge-transporting material) disposed on a support and an upper layer (comprising the charge transport layer or the charge generation layer) disposed on the lower layer, the upper layer (i.e., the charge transport layer or the charge generation layer) corresponds to the surface layer.

In the present invention, the charge transport layer (as the upper layer) may preferably be the surface layer in view of electrophotographic characteristics.

The charge transport layer may be formed by applying (wet-coating) a solution of a binder resin and the charge-transporting material in an appropriate solvent and drying the resultant wet coating. Examples of the charge-transporting material may include a triarylamine compound, a hydrazone compound, a stilbene compound, a pyrazoline compound, an oxazole compound, a triarylmethane compound and a thiazole compound. The binder resin comprises the above-mentioned polyester resin in the case where the charge transport layer is the surface layer or comprises various resins (other than the polyester resin) in the case where the charge transport layer is not the surface layer. The charge-transporting material and the binder resin may preferably be mixed in a weight ratio of 1:0.5 to 1:2. The thus formed charge transport layer may preferably have a thickness of 5–40 $\mu$m, more preferably 15–30 $\mu$m.

The charge generation layer may be formed by applying a dispersion prepared by well dispersing a mixture of the charge-generating material, a binder resin (in an amount (by weight) 0.3–4 times that of the charge-generating material) in a dispersion means (such as, a homogenizer, an ultrasonic dispersion mill, a ball mill, a vibration ball mill, a sand mill, an attritor, a roll mill, and a high-speed dispersion machine of a liquid impingement-type and drying the resultant wet coating. Examples of the charge-generating material may include selenium-tellurium, pyrilium or thiopyrilium dyes, phthalocyanine pigments anthoanthrone pigments, dibenzopyrenequinone pigments, trisazo pigments, cyanine dyes, disazo pigments, monoazo pigments, indigo pigments, quinacridone pigments and asymmetric quinocyanine pigments. The binder resin comprises the above-mentioned polyester resin in the case where the charge transport layer is the surface layer or comprises various resins (other than the polyester resin) in the case where the charge transport layer is not the surface layer. The thus formed charge generation layer may preferably have a thickness of at most 5 $\mu$m, more preferably 0.1–2 $\mu$m.

The single layer-type photosensitive layer may be formed by applying a coating liquid prepared by dispersing or dissolving the above-mentioned charge-generating and charge-transporting material in the above-mentioned binder resins and drying the resultant wet coating. The thus formed photosensitive layer may preferably have a thickness of 5–40 $\mu$m, more preferably 15–30 $\mu$m.

When the protective layer is disposed on the photosensitive layer, the protective layer may be formed by applying a solution of the polyester resin and an optional additive such as an organic or inorganic resistivity-controlling agent, as desired in an appropriate solvent and drying the resultant wet coating. The thus formed protective layer may preferably have a thickness of 0.5–10 $\mu$m, more preferably 1–5 $\mu$m.

The support of the photosensitive member may comprise any electroconductive material and may be formed in a sheet shape or a cylindrical shape. Examples of the electroconductive material may include metals such as aluminum and stainless steel; and metals, paper and plastics each provided with an electroconductive layer.

In the present invention, between the support and the photosensitive layer, it is possible to dispose an electroconductive layer for the purpose of prevention of interference fringes and coating for mars on the support. Such an electroconductive layer may be formed by applying a dispersion of electroconductive particles such as carbon black, metal particles and metal oxide particles in an appropriate binder resin and drying the resultant wet coating. The thus formed electroconductive layer may preferably have a thickness of 5–40 $\mu$m, particularly 10–30 $\mu$m.

Further, in the present invention, an intermediate layer having an adhesion function and a barrier function may be disposed between the support and the photosensitive layer or between the electroconductive layer and the photosensitive layer, as desired. Examples of a material for the intermediate layer may include polyamide, polyvinyl alcohol, polyethylene oxide, ethyl cellulose, casein, polyurethane and polyether-urethane. These materials may be applied in a solution in an appropriate solvent. The thus formed intermediate layer may preferably have a thickness of 0.05–5 $\mu$m, particularly 0.3–1 $\mu$m.

The electrophotographic photosensitive member according to the present invention can be applied to not only an ordinary electrophotographic copying machine but also a laser beam printer, a light-emitting diode (LED) printer, a cathode-ray tube (CRT) printer, a liquid crystal printer, and other fields of applied electrophotography including, e.g., laser plate making.

Hereinbelow, an embodiment of an electrophotographic apparatus including a process cartridge using the photosensitive member according to the present invention will be explained with reference to the sole FIGURE.

The FIGURE shows a schematic structural view of such an electrophotographic apparatus of the invention. Referring to the FIGURE, a photosensitive drum (i.e., photosensitive member) 1 according to the present invention is rotated about an axis 2 at a prescribed peripheral (process) speed in the direction of an arrow shown inside of the photosensitive drum 1. The surface of the photosensitive drum 1 is uniformly charged by using a primary charging means (charger) 3 (contact charging means in the FIGURE) to have a prescribed positive or negative potential during the rotation. The photosensitive drum 1 is (image-) exposed to light 4 (as by slit exposure or laser beam-scanning exposure) by using an exposure means (not shown) in a step of (image-) exposure, whereby an electrostatic latent image corresponding to an exposure image is successively formed on the surface of the photosensitive drum 1. The thus formed electrostatic latent image is developed by a developing means 5 to form a toner image in a step of developing. The developed toner image is successively transferred to a transfer(-receiving) material 7 which is supplied from a supply part (not shown) to a position between the photosensitive drum 1 and a transfer means (charger) 6 in synchronism with the rotation of the photosensitive drum 1, by means of the transfer means 6. The transfer material 7 with the transferred toner image thereon is separated from the photosensitive drum 1 to be conveyed to an image-fixing means 8, followed by image fixing to print out the transfer material 7 as a copy outside the electrophotographic apparatus. Residual toner particles on the surface of the photosensitive drum 1 after the transfer are removed by a cleaning means (cleaner) 9 to provide a cleaned surface, and residual charge on the surface of the photosensitive drum 1 is erased by pre-exposure light 10 emitted from a pre-exposure means (not shown) to prepare for the next cycle. As shown in the FIGURE, when the primary charging means 3 is a contact charging means using a charging roller etc., the pre-exposure step may be omitted as desired.

In the electrophotographic apparatus, it is possible to provide a process cartridge which includes plural means inclusive of or selected from the photosensitive member (photosensitive drum) 1, the primary charging means 3, the developing means 5, the cleaning means 9, etc. so as to be detachably mountable to a main body of the apparatus. The process cartridge may, for example, be composed of the photosensitive member 1 and at least one means selected from the group consisting of the primary charging means 3, the developing means 5 and the cleaning means 9 to prepare a single unit capable of being attached to or detached from the main body of the electrophotographic apparatus by using a guiding means such as rails 12 in the apparatus body.

In the case where the electrophotographic apparatus is used as a copying machine or a printer, (image-)exposure light 4 may be provided by reading a data on reflection light or transmitted light from an original or by reading a data on the original by means of a sensor, converting the data into a signal and then effecting a laser beam scanning, a drive of LED array or a drive of a liquid crystal shutter array so as to expose the photosensitive member surface to the light 4 depending on the signal.

Hereinbelow, the present invention, will be explained more specifically with reference to examples. In the following, "part(s)" means "weight part(s)".

EXAMPLE 1

On an aluminum cylinder (30 mm (diameter)×254 mm (width)), a 15 μm-thick electroconductive layer was formed by applying a coating liquid composed of a mixture of the following ingredients by dip coating, followed by hot curing for 30 min. at 140° C.

| Ingredients | part(s) |
|---|---|
| $SnO_2$-coated barium sulfate (electroconductive pigment) | 10 |
| Titanium oxide (resistance-controlling pigment) | 2 |
| Phenolic resin (binder resin) | 6 |
| Silicone oil (leveling agent) | 0.001 |
| Methanol/methoxypropanol (¼ by weight) (solvent) | 20 |

On the electroconductive layer, a solution of 3 parts of N-methoxymethylated nylon and 3 parts of a copolymer nylon in a mixture solvent of 70 parts of methanol and 30 parts of n-butanol was applied by dip coating, followed by drying to obtain a 0.3 μm-thick intermediate layer.

A coating liquid for a charge generation layer was prepared by mixing 4 parts of oxytitanium phthalocyanine (showing four main peaks at bragg angles (2θ±0.2 degree) of 9.0 degrees, 14.2 degrees, 23.9 degrees and 27.1 degrees in X-ray diffraction pattern based on CuKα characteristic X-ray), 2 parts of a polyvinyl butyral ("S-LEC BM2", mfd. by Sekisui Kagaku Kogyo K.K.) and 60 parts of cyclohexanone in a sand mill using 1 mm glass beads for 4 hours and by adding 100 parts of ethyl acetate to the mixture.

The thus prepared coating liquid was applied onto the intermediate layer by dipping and dried to form a 0.3 μm-thick charge generation layer.

A coating liquid for a charge transport layer was prepared by dissolving a mixture of 10 parts of a polyester resin (Resin No. 1 shown in Table 1 appearing hereinafter) prepared similarly as in Synthesis Example 1 and 8 parts of a triarylamine compound of the formula:

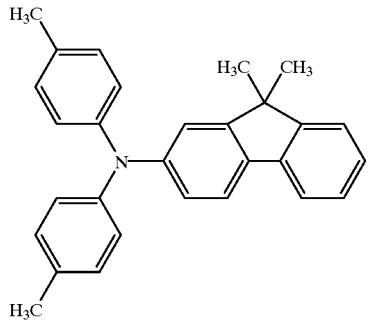

in a mixture solvent of 50 parts of monochlorobenzene and 50 parts of dichloromethane.

The thus prepared coating liquid was applied onto the charge generation layer by dipping, followed by drying for 1 hour at 120° C. to form a 25 μm-thick charge transport (surface) layer, thus preparing an electrophotographic photosensitive member.

The thus prepared photosensitive member was installed in a remodeled machine of a laser beam printer ("Laser Jet 4 Plus", mfd. by Hewlett-Packard Company) equipped with a contact charging means as a primary charger. The laser beam printer was remodeled so that a peak-to-peak voltage of an AC voltage applied at the time of the primary charging was increased to 125% of that in an original state and a potentiometer was connected so as to be suitable for measurement of electrophotographic characteristics.

The measurement of the electrophotographic characteristics was performed in an environment of 23° C. and 50% RH (normal temperature—normal humidity environment) in terms of a dark-part potential Vd (volt) and a sensitivity Δ500 ($\mu J/cm^2$).

A larger value (absolute value) of the dark-part potential represents a better chargeability.

The sensitivity Δ500 was evaluated as a light energy required for decreasing a surface potential from −700 volts to −200 volts per unit area.

A lower value of the sensitivity Δ500 represents a better sensitivity.

The photosensitive member installed in the laser beam printer was then subjected to a successive image formation test on 7000 sheets in an intermittent mode in the normal temperature-normal humidity environment to evaluate an image quality and an abrasion degree of the photosensitive member surface.

The image formation test was performed with respect to a character image pattern on an A4-sized sheet (image area=5%).

After the image formation test, the abrasion degree was measured by means of an eddy-current thickness meter ("Permascope Type 111", mfd. by Fisher Co.).

Further, the image quality was evaluated as an occurrence of fogs on the prescribed sheets by eye observation.

The results are shown in Table 3 appearing hereinafter.

EXAMPLE 2–12

Each of photosensitive members was prepared and evaluated in the same manner as in Example 1 except that the polyester resin (Resin No. 1) for the charge transport layer was changed to those (Resin Nos. 2–12) shown in Table 1, respectively.

The results are shown in Table 3.

COMPARATIVE EXAMPLES 1–4

Each of photosensitive members was prepared and evaluated in the same manner as in Example 1 except that the polyester resin (Resin No. 1) was changed to those (Comparative Resin Nos. 1–4) shown in Table 2, respectively.

The results are shown in Table 3.

TABLE 1

| Ex. No. | Resin No. | Structural unit A | Structural unit B | Molar resin (unit A/unit B) | Mw |
|---|---|---|---|---|---|
| 1 | 1 | No. 1 | No. 3 | 50/50 | 30000 |
| 2 | 2 | No. 1 | No. 3 | 30/70 | 31000 |
| 3 | 3 | No. 1 | No. 6 | 40/60 | 32000 |
| 4 | 4 | No. 1 | No. 7 | 40/60 | 32000 |
| 5 | 5 | No. 1 | No. 7 | 60/40 | 28000 |
| 6 | 6 | No. 2 | No. 7 | 30/70 | 30000 |
| 7 | 7 | No. 3 | No. 1 | 40/60 | 28000 |
| 8 | 8 | No. 4 | No. 7 | 40/60 | 32000 |
| 9 | 9 | No. 5 | No. 7 | 40/60 | 30000 |
| 10 | 10 | No. 7 | Pc-A*1 | 50/50*2 | 30000/ 25000*3 |

TABLE 1-continued

| Ex. No. | Resin No. | Structural unit A | Structural unit B | Molar resin (unit A/unit B) | Mw |
|---|---|---|---|---|---|
| 11 | 11 | No. 7 | Pc-Z*1 | 70/30*2 | 30000/ 40000*3 |
| 12 | 12 | No. 7 | Pc-C*1 | 70/30*2 | 30000/ 35000*3 |

*1Pc-A: Bisphenol A-type polycarbonate
Pc-Z: Bisphenol Z-type polycarbonate
Pc-C: Bisphenol C-type polycarbonate
*2These ratios represented a mixing ratio (by weight) of the polyester resin (unit A) and the polycarbonate (unit B) since each of the binder resins used in Examples 10–12 was a mixture of the polyester resin and the polycarbonate resin.
*3Mw of unit A/Mw of unit B

TABLE 2

| Comp. Ex. No. | Comp. Resin No. | Structural unit | Mw |
|---|---|---|---|
| 1 | 1 | 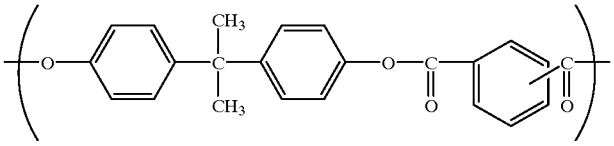 | 35000 |
| 2 | 2 | 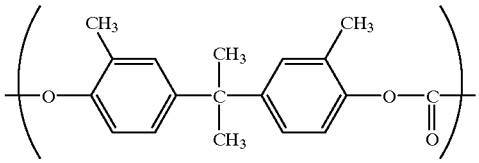 | 30000 |
| 3 | 3 | 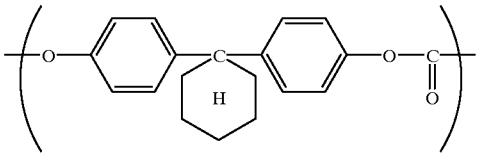 | 30000 |
| 4 | 4 | 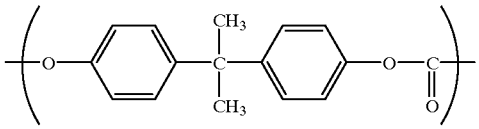 | 33000 |

TABLE 3

| Ex. No. | Vd (−V) | Δ500 (μJ/cm²) | Abrasion degree (μm) | Image** quality |
|---|---|---|---|---|
| Ex. 1 | 710 | 0.51 | 3.5 | A |
| Ex. 2 | 730 | 0.52 | 5.4 | A |
| Ex. 3 | 700 | 0.53 | 5.2 | A |
| Ex. 4 | 710 | 0.52 | 5.0 | A |
| Ex. 5 | 710 | 0.55 | 5.4 | A |
| Ex. 6 | 720 | 0.53 | 5.2 | A |
| Ex. 7 | 710 | 0.51 | 5.4 | A |
| Ex. 8 | 710 | 0.54 | 5.6 | A |
| Ex. 9 | 720 | 0.52 | 5.4 | A |
| Ex. 10 | 710 | 0.54 | 5.2 | A |
| Ex. 11 | 700 | 0.52 | 5.4 | A |
| Ex. 12 | 720 | 0.53 | 5.6 | A |
| Comp. Ex. 1 | 710 | 0.52 | 10.1 | B (ca. 5500) |
| " 2 | 720 | 0.57 | 11.2 | B (ca. 6000) |

TABLE 3-continued

| Ex. No. | Vd (−V) | Δ500 (μJ/cm²) | Abrasion degree (μm) | Image** quality |
|---|---|---|---|---|
| " 3 | 700 | 0.54 | 11.5 | B (ca. 5000) |
| " 4 | 710 | 0.56 | 11.8 | B (ca. 4800) |

**A: Good image with no fogs were observed.
B: Fogs occurred on the resultant images after image formation on the indicated sheets (in parentheses)

As described hereinabove, according to the present invention, by using a layer containing the polyester resin of the formula (1) characterized by a particular divalent aliphatic hydrocarbon group as a surface layer of a photosensitive member, the resultant photosensitive member is effectively improved in abrasion resistance and electrophotographic characteristics even when subjected to a successive image formation.

What is claimed is:

1. A process cartridge detachably mountable to an electrophotographic apparatus main body, comprising:

an electrophotographic photosensitive member and contact charging means, wherein said electrophotographic photosensitive member comprises a support and a photosensitive layer disposed on the support, and said electrophotographic photosensitive member has a surface layer comprising a polyester resin having a recurring unit represented by the following formula (1):

(1)

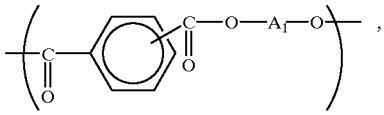

wherein $A_1$ represents a substituted or unsubstituted divalent aliphatic hydrocarbon group.

2. An electrophotographic apparatus comprising:

an electrophotographic photosensitive member, contact charging means, exposure means, developing means and transfer means, wherein said electrophotographic photosensitive member comprises a support and a photosensitive layer disposed on the support, and said electrophotographic photosensitive member has a surface layer comprising a polyester resin having a recurring unit represented by the following formula (1):

(1)

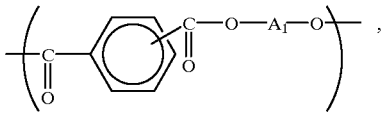

wherein $A_1$ represents a substituted or unsubstituted divalent aliphatic hydrocarbon group.

3. A process cartridge according to claim 1, wherein said aliphatic hydrocarbon group has an alicyclic ring structure.

4. A process cartridge according to claim 3, wherein said alicyclic ring structure is represented by the following formula (2):

$$—R_1—A_2—R_2— \quad (2),$$

wherein $R_1$ and $R_2$ are each a substituted or unsubstituted alkylene group and $A_2$ is a substituted or unsubstituted divalent alicyclic hydrocarbon group.

5. A process cartridge according to claim 4, wherein said recurring unit of a polyester resin is represented by the following formula (3):

(3)

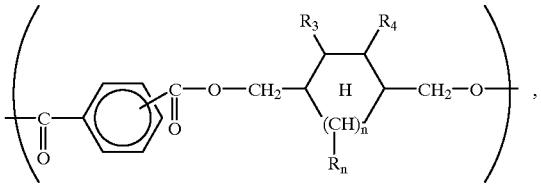

wherein $R_3$, $R_4$ and $R_n$ are each hydrogen, halogen or an alkyl group; and n is 1, 2 or 3.

6. A process cartridge according to claim 4, wherein said polyester resin comprises a copolymer having a recurring unit represented by the following formula (4) and a recurring unit represented by the following formula (5):

(4)

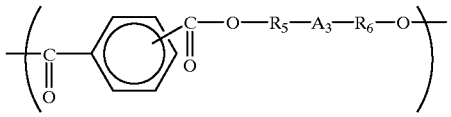

wherein $R_5$ and $R_6$ are each a substituted or unsubstituted alkylene group and $A_3$ is a substituted or unsubstituted divalent cyclic hydrocarbon group; and (5)

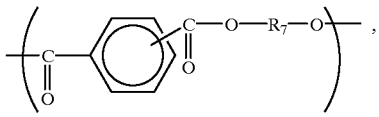

wherein $R_7$ is a substituted or unsubstituted divalent chain aliphatic hydrocarbon group.

7. A process cartridge according to claim 6, wherein said polyester resin comprises a copolymer having a recurring unit represented by the following formula (3) and a recurring unit represented by the following formula (6):

(3)

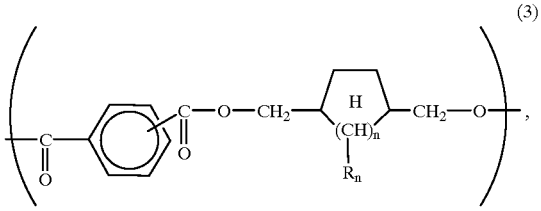

wherein $R_3$, $R_4$ and $R_n$ are each hydrogen, halogen or an alkyl group; and n is 1, 2 or 3, and (6)

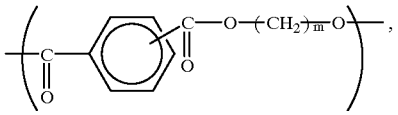

wherein m is an integer of 2–6.

8. An electrophotographic apparatus according to claim 2, wherein said aliphatic hydrocarbon group has an alicyclic ring structure.

9. An electrophotographic apparatus according to claim 8, wherein said alicyclic ring structure is represented by the following formula (2):

$$—R_1—A_2—R_2— \quad (2)$$

wherein $R_1$ and $R_2$ are each a substituted or unsubstituted alkylene group and $A_2$ is a substituted or unsubstituted divalent alicyclic hydrocarbon group.

10. An electrophotographic apparatus according to claim 9, wherein said recurring unit of a polyester resin is represented by the following formula (3):

(3)

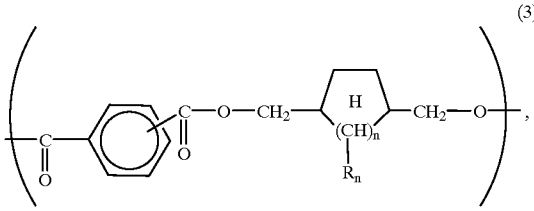

wherein $R_3$, $R_4$ and $R_n$ are each hydrogen, halogen or an alkyl group; and n is 1, 2 or 3.

11. An electrophotographic apparatus according to claim 9, wherein said polyester resin comprises a copolymer having a recurring unit represented by the following formula (4) and a recurring unit represented by the following formula (5):

(4)

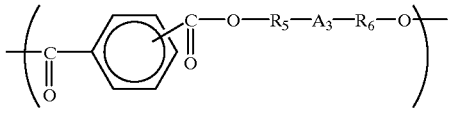

wherein $R_5$ and $R_6$ are each a substituted or unsubstituted alkylene group and $A_3$ is a substituted or unsubstituted divalent alicyclic hydrocarbon group; and (5)

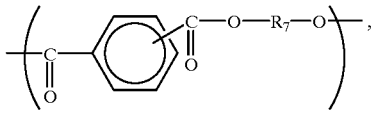

wherein $R_7$ is a substituted or unsubstituted divalent chain aliphatic hydrocarbon group.

12. An electrophotographic apparatus according to claim 11, wherein said polyester resin comprises a copolymer having a recurring unit represented by the following formula (3) and a recurring unit represented by the following formula (6):

(3)

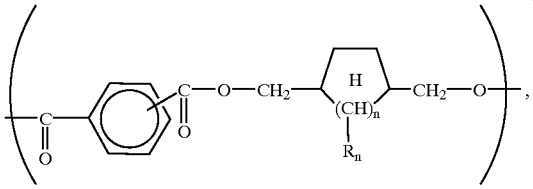

wherein $R_3$, $R_4$ and $R_n$ are each hydrogen, halogen or an alkyl group; and n is 1, 2 or 3, and (6)

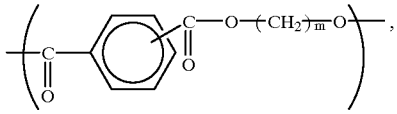

wherein m is an integer of 2–6.

* * * * *

UNITED STATES PATENT AND TRADEMARK OFFICE

CERTIFICATE OF CORRECTION

PATENT NO. : 6,185,398 B1
DATED : February 6, 2001
INVENTOR(S) : Takakazu Tanaka et al.

It is certified that error appears in the above-identified patent and that said Letters Patent is hereby corrected as shown below:

Column 6,
Line 17, "unit," should read -- units, --.

Column 7,
Line 41, "pigments" should read -- pigments, --.

Column 14,

Line 30, "—O—" should read -- —O—, --;

Line 39, "cyclic" should read -- alicyclic --;

Line 55, "

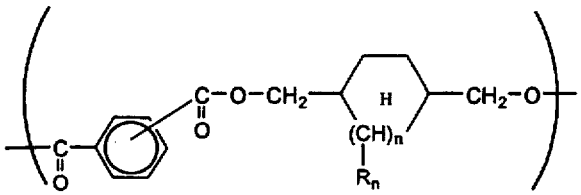

(3)"

Should read --

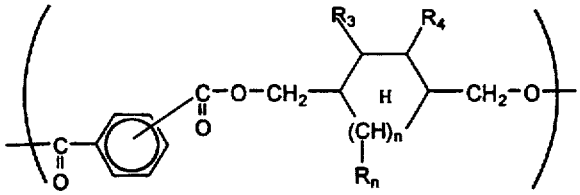

(3)--.

Column 15,

Line 30, "

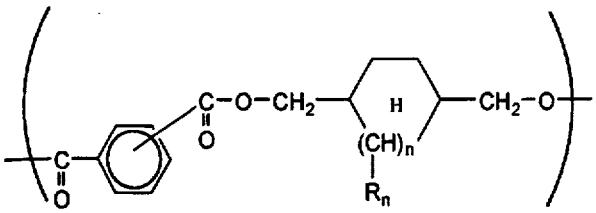

(3)"

should read --

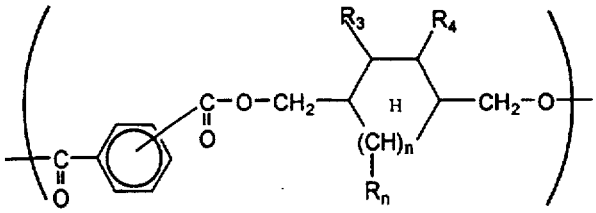

(3)--.

UNITED STATES PATENT AND TRADEMARK OFFICE

CERTIFICATE OF CORRECTION

PATENT NO. : 6,185,398 B1
DATED : February 6, 2001
INVENTOR(S) : Takakazu Tanaka et al.

It is certified that error appears in the above-identified patent and that said Letters Patent is hereby corrected as shown below:

Column 16,

Line 1, "—O—)" should read -- —O—), --;

Line 25, "

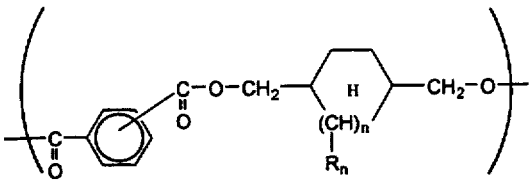

(3)"

should read --

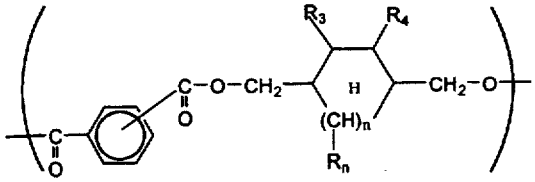

(3)--.

Signed and Sealed this

Fifth Day of February, 2002

*Attest:*

*Attesting Officer*

JAMES E. ROGAN
*Director of the United States Patent and Trademark Office*